US006860214B1

(12) United States Patent
Wang

(10) Patent No.: US 6,860,214 B1
(45) Date of Patent: Mar. 1, 2005

(54) RAISED EMBROIDERY PROCESS

(76) Inventor: Tai Kuang Wang, P.O. Box 82-144, Sec. 2, Taipei (TW)

( * ) Notice: Subject to any disclaimer, the term of this patent is extended or adjusted under 35 U.S.C. 154(b) by 0 days.

(21) Appl. No.: 10/665,068

(22) Filed: Sep. 22, 2003

(51) Int. Cl.[7] ..... D05C 17/00
(52) U.S. Cl. ..... 112/475.22
(58) Field of Search ..... 112/475.18, 475.22, 112/439, 475.11, 470.01, 470.05, 100, 102.5, 45, 456; 2/244, 246; 156/93; 83/23, 27, 910

(56) References Cited

U.S. PATENT DOCUMENTS 5,005,500 A * 4/1991 Kato et al. ..... 112/102.5
5,241,919 A * 9/1993 LaGreca ..... 112/410
5,609,119 A * 3/1997 Yeh ..... 112/475.23
5,947,044 A * 9/1999 Lin et al. ..... 112/475.22
6,158,055 A * 12/2000 Park ..... 2/195.1

* cited by examiner

*Primary Examiner*—Ismael Izaguirre
(74) *Attorney, Agent, or Firm*—Leong C. Lei

(57) ABSTRACT

A raised embroidery process includes placing a piece of filler on an embroidering background fabric; partially supplementary embroidering by threads of appropriate colors on the short sides and wherever necessary of the embroidering pattern, thereby sewing part of the filler and the corresponding embroidery background fabric together, i.e. affixing the filler on the background fabric; stitching by various appropriate colors along the pre-determined embroidery paths to cover and wrap the whole raised embroidering pattern, including the filler and the embroidering background fabric; removing the outer portion of the filler surrounding the embroidering portion from the embroidering portion, and passing the whole background fabric with the wrapped filler through an oven conveyor at a pre-set temperature to shrink the filler; tucking in the filler stub exposed out of inter-threads by a sharp stick to make the side edges of raised embroidering pattern more aesthetic.

6 Claims, 6 Drawing Sheets

RAISED EMBROIDERY PROCESS

BACKGROUND OF THE INVENTION (a) Technical Field of the Invention

The present invention relates to a raised embroidery process, and is particularly to one process applicable to all kinds of fabric and articles so as to obtain a raised embroidery masterpiece.

(b) Description of the Prior Art

There are many kinds of embroideries on general fabric, such as plane embroidery, extruding embroidery, etc. Plane embroidery is directly processed on a fabric without adding any filler such that the thread will be stitched through the fabric to appear a plane embroidery pattern. Extruding embroidery is processed by pre-placing a filler on the area to be embroidered and covering said embroidering area with the filler by thread, so as to accomplish an extruding embroidery work.

Extruding embroidery process in the prior art generally adopts pile-up process, i.e. stitching on the fabric from a smaller embroidery portion and piling up the thread layer-by-layer until the thread layer has extruded. However, such extruding embroidery process is quite time-and-cost consuming, which cannot be considered as an ideal process.

In view of the above, improved extruding embroidery processes have been disclosed in U.S. Pat. Nos. 5,832,854, 5,947,044 and 6,164,228.

In U.S. Pat. No. 5,832,854, the extruding embroidery is processed by pre-perforating densely on the filler along the outline of the 3D embroidery pattern via needle without thread such that the filler on the fabric may have consecutive interval perforations in-between the portion to be covered by thread and the portion not to be covered by thread, covering the embroidery pattern by needles with threads, and finally taking off the leftover filler to complete an extruding embroidery work.

In the above-mentioned disclosure, the perforation actually goes through the fabric, so that the fabric would have consecutive interval perforations as those left on the filler, followed by the subsequent embroidering process makes a closer perforations on the outline of the 3D embroidery pattern, which has the following disadvantages:

1. The formation of consecutive interval perforations is quite time-consuming, rendering a low efficiency in mass production.
2. Additional stitch on the consecutive interval perforations lessens the tensile strength of the fabric along the outline of the 3D embroidery pattern due to the fabric's being destroyed by the consecutive interval perforations. While the fabric may have uneven perforation intervals, when the fabric is under tensile force, which would become uneven consequently, the fabric under the edge of the 3D embroidery pattern would become easily worn.
3. In U.S. Pat. No. 5,832,854, it requires much time and work to adhere or sew the filler on the background material for affixing purposes.

Regarding U.S. Pat. No. 5,947,044, the disclosure differs from that of U.S. Pat. No. 5,832,854 in terms of the filler placed on the fabric, which will shrink in volume when being heated (i.e. heat shrink material). Via a computerized embroidering machine, the filler is covered by thread according to the embroidery pattern. After the unembroidered filler is torn off, the edge of the embroidery pattern is baked by heat such that the filler left with the edge of the raised embroidery will shrink inside and that a raised embroidery work is completed.

While the disclosure emphasize heating the extruded embroidery edge to shrink the leftover filler, the heating procedure is conducted manually on the embroidery work one by one, rendering uneven heating effect, much time and work, higher cost, and inferior quality.

Furthermore, in case leftover fillers of bigger size expose, even if applying heat cannot make it shrunk and hidden inside of the embroidery threads, thereby making a rough edge of the embroidery pattern. In addition, the relevant skills of shrinking the filler by a heater have already been disclosed in Japanese Patent No. 7-316973 (filed on May 23, 1994) which is much earlier an U.S. Pat. No. 5,947,044 (filed on Feb. 10, 1998).

Further referring to U.S. Pat. No. 6,164,228, the main object is to place a filler of proper size, hardness and thickness on the fabric; covering an area smaller than the desired pattern via a computerized embroidering machine; removing the unnecessary leftover filler to form an inner protruding embroidery layer smaller than the desired pattern; and covering and shading the inner layer by thread, so as to complete an embroidery work. However, in such process, large quantity of threads and process time would be required, thus increasing the cost.

SUMMARY OF THE INVENTION

The primary object of the invention is to provide an embroidery process, which allows passing the whole embroidery fabric along with the filler through an oven conveyor at a pre-set temperature, so that the filler will shrink evenly to form an aesthetic raised embroidery pattern.

Another object of the invention is to provide a raised embroidery process, which includes embroidery paths, which are specifically designed for process without pre-fixing filler or pre-perforating densely on the background fabric.

Another object of the invention is to provide a raised embroidery process, which doesn't need embroidering twice to cover the leftover fillers.

To reach the above objects, the present invention includes the following steps:

A. placing a piece of filler on an embroidering background fabric such that the filler, having a size larger than that of the raised embroidery pattern, may cover the pre-determined embroidery pattern;

B. conducting a supplementary embroidering procedure, i.e. sewing by threads of appropriate colors from the edge of short sides of the embroidery pattern toward the inner portion of the pattern, thereby a part of the filler can be sewed and affixed to the corresponding background fabric;

C. entirely wrapping up the embroidering portion of the filler and the background fabric by sewing with threads of various colors along the pre-determined embroidery paths (50*a*, 50*b*, 50*c*);

D. removing the outer portion of the filler surrounding the embroidering portion from the embroidering portion, and passing the whole background fabric with the wrapped filler trough an oven conveyor at a pre-set temperature, so that the filler will shrink to form an aesthetic raised embroidery pattern; and E. in case tiny filler stubs expose out of the inter-threads, they can be tucked into the embroidery pattern and hidden inside by a small sharp stick, thereby embellishing the embroidery pattern.

DETAILED DESCRIPTION OF THE EMBODIMENT

Figure 1:
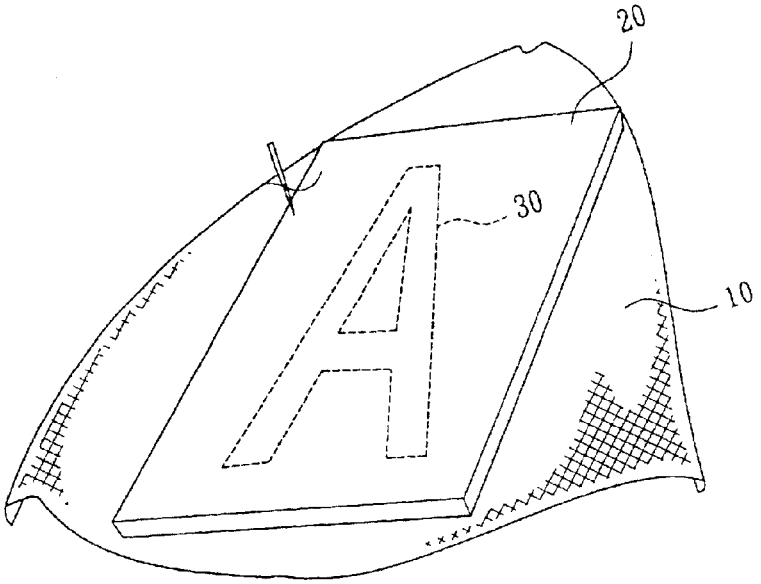
FIG. 1 shows step A of the invention.
Figure 2:
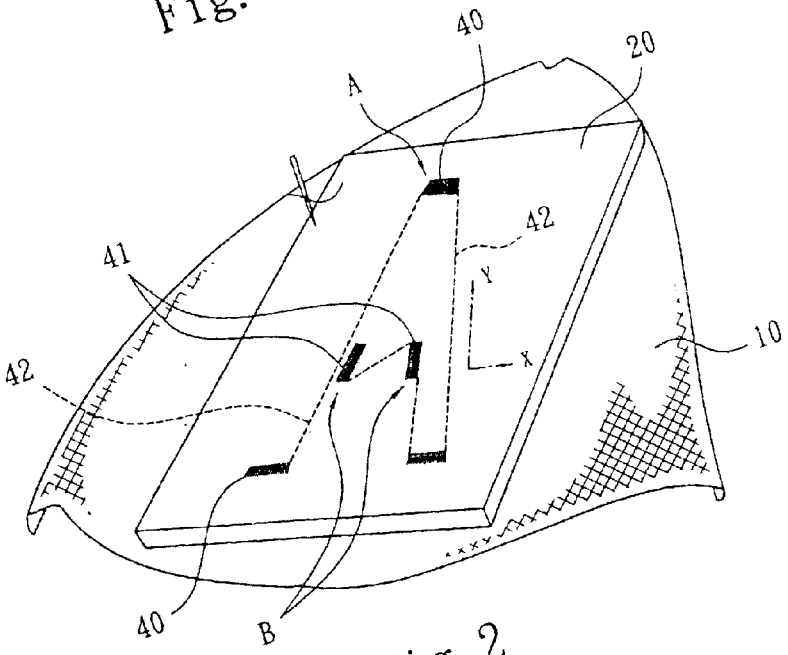
FIG. 2 shows step B of the invention.
Figure 3:
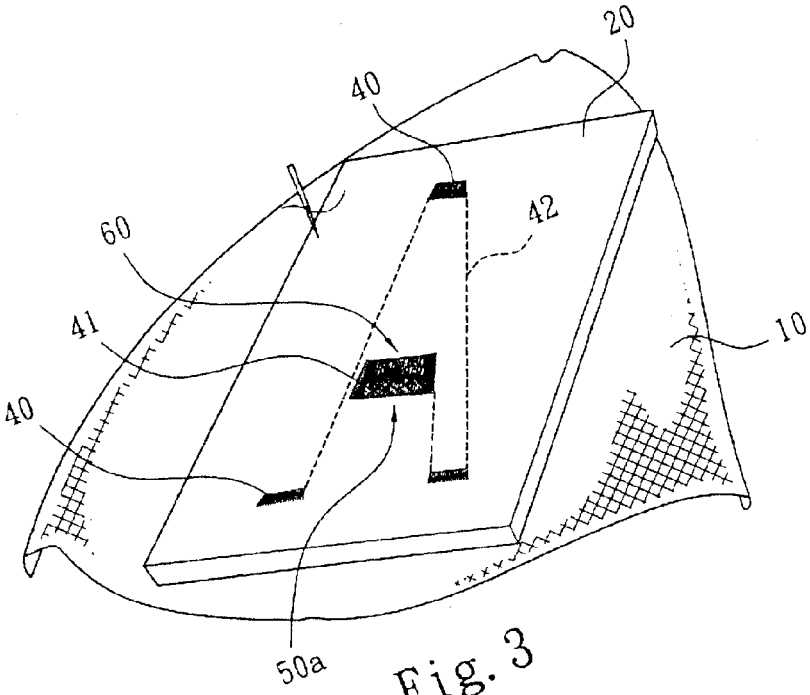
FIG. 3 shows step C of the invention.
Figure 4:
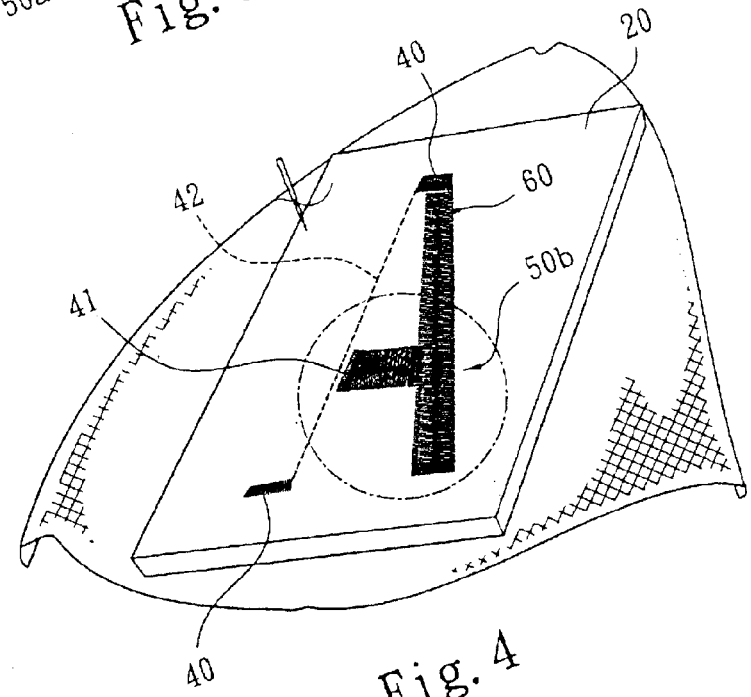
FIG. 4 shows step C of the invention.
Figure 5:
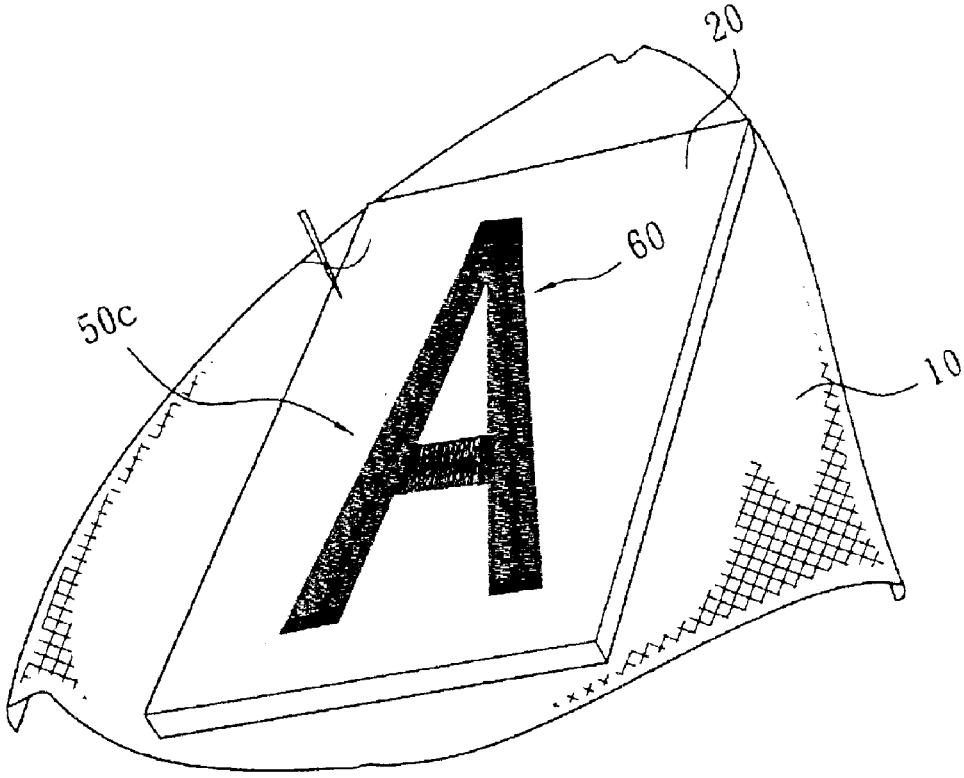
FIG. 5 is a schematic view showing the invention during the process when step C is accomplished.

Referring to FIGS. 1 to 6, the raised embroidery process according to the present invention can pass the whole embroidery fabric along with the filler through an oven conveyor for heating purposes. This process not only can be adapted to mass production, but also can evenly shrink the filler to achieve embroidery masterpieces. Besides, the pre-designed embroidery paths can spare the procedure of affixing the filler or pre-perforating densely on the background fabric. The present invention includes the following steps:

A. placing a piece of filler 20 on an embroidering background fabric 20 such that the filler 20, having a size larger than that of the raised embroidery pattern, may cover the pre-determined embroidery pattern 30 (as shown in FIG. 1);

B. conducting a supplementary embroidering procedure on the short sides A or wherever necessary (such as the area 41 where different directions of outmost surface embroidering threads of the 3D embroidery design being adjacent), i.e. sewing by threads of appropriate colors from the edge of short sides 40 of the embroidery pattern toward the inner portion of the pattern, and on the adjoining area 41 (*In the absence of said supplementary embroidering step, the filler will easily expose on the short sides A or on the adjoining area 41); the supplementary embroidery procedure farther includes sewing the connecting stitches 42 between said short sides and/or said adjoining areas of the pattern, thereby a part of the filler 20 can be sewed and affixed to the corresponding background fabric 10 (as shown in FIG. 2);

C. entirely wrapping up the embroidering portion of the filler and the background fabric 10 by sewing with threads 60 of various colors along the pre-determined embroidery paths 50*a*, 50*b*, 50*c* (as shown in FIGS. 3, 4 and 5, respectively); In the preferred embodiment as shown, the embroidery path 50*a* is for stitching threads to cover half of the adjoining area 41, while embroidery paths 50*b* and 50*c* will cover the remaining half of the adjoining area 41, thereby the filler 20 would not expose from the adjoining area 41 of threads of different embroidery paths 50*a*, 50*b* or occur unexpected extrusions.

Figure 6:
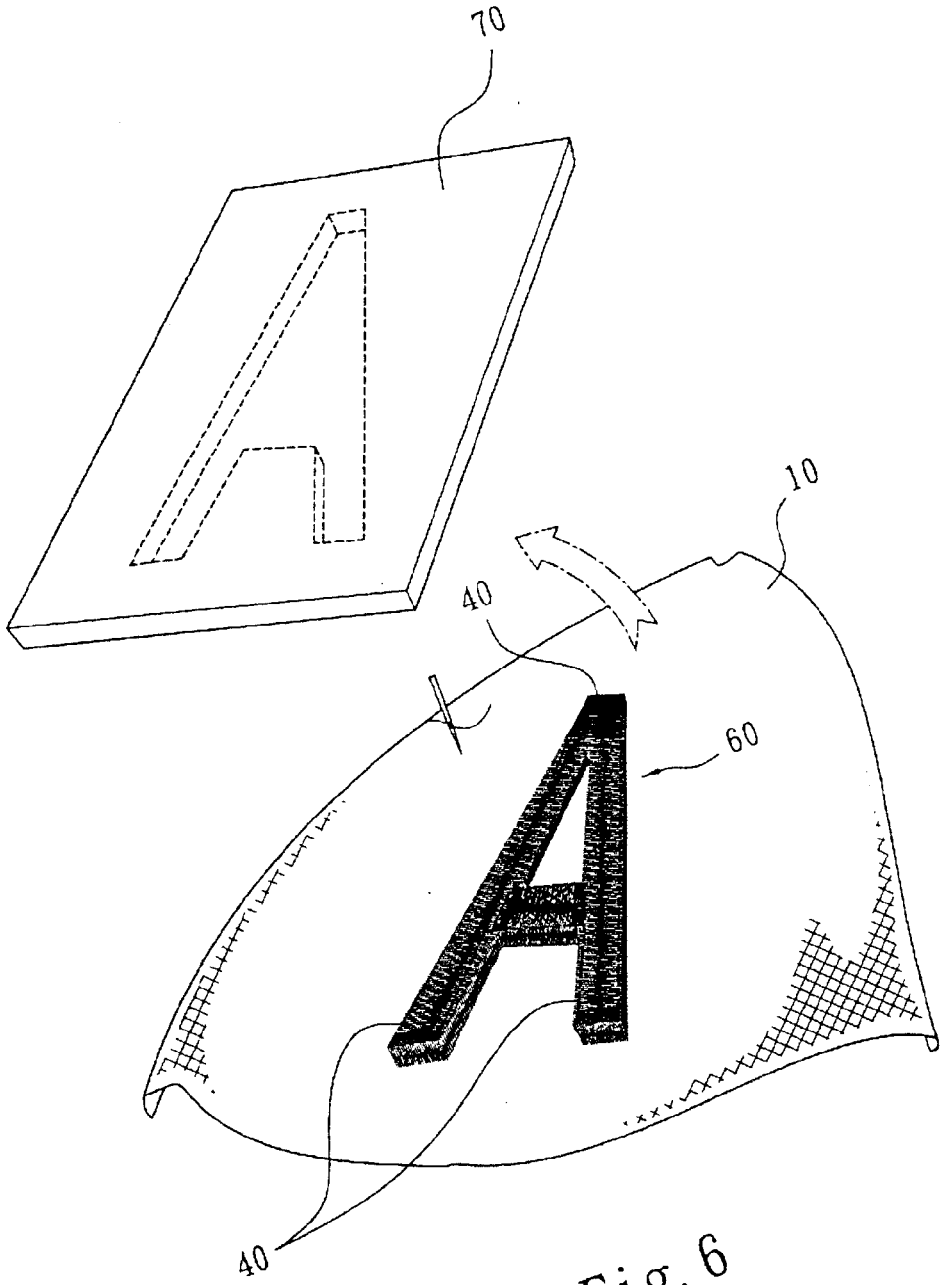
FIG. 6 shows step D of the invention.
Figure 7:
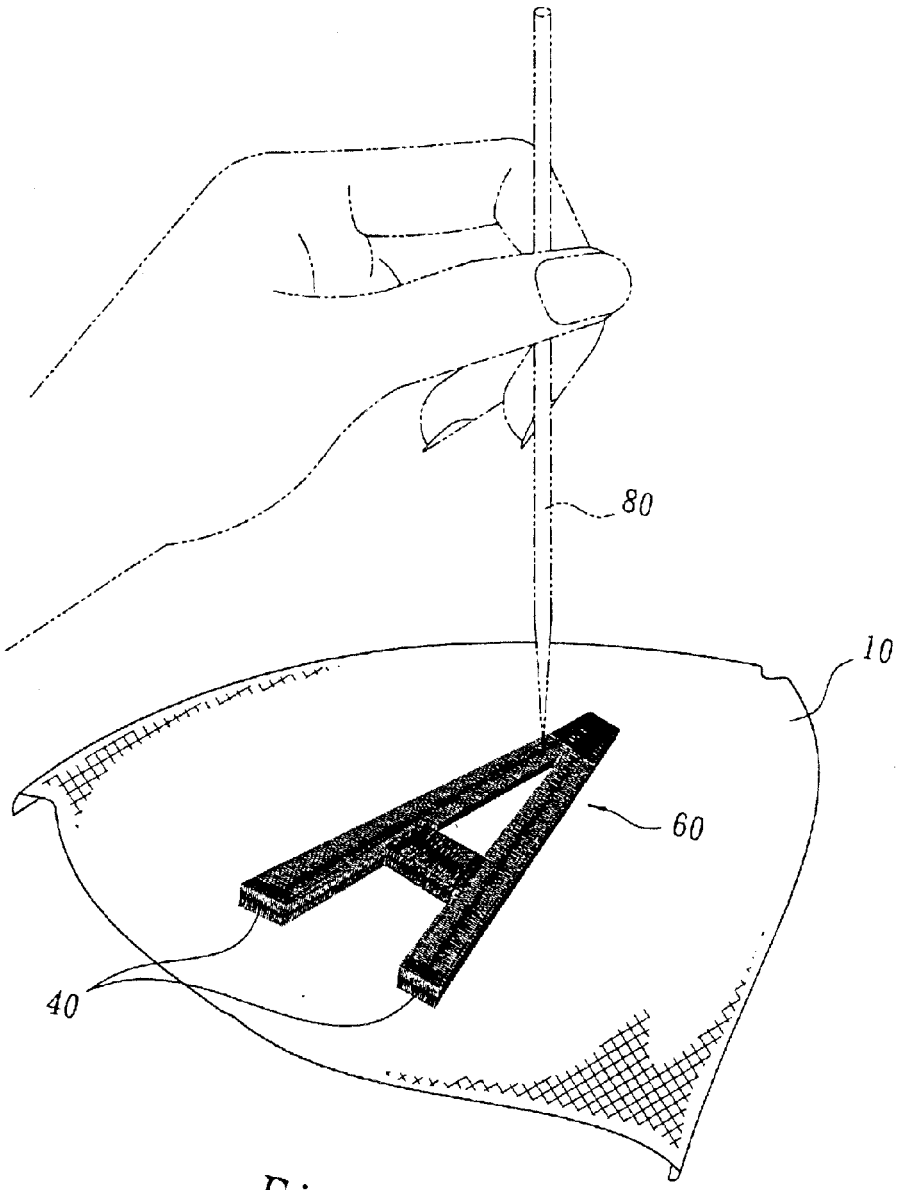
FIG. 7 shows embellishing the embroidery by a sharp stick during the process.

D. removing the outer portion of the filler surrounding the embroidering portion from the embroidering portion, and passing the whole background fabric 10 with the wrapped filler 60 through an oven conveyor at a pre-set temperature, so that the filler stubs will shrink to make the side edges of the raised embroidering pattern more aesthetic (as shown in FIG. 6). By way of the above steps, a fine piece of raised embroidery can be accomplished. The process according to the invention can permit efficient production. While the filler can be various materials, in the case of rayon of longer fiber, before the step of shorting filler 70 whose periphery is not wrapped by lads and the filler 60 already wrapped by threads, step E can be additional applied to the filler stubs not completed shrink, if any, as follows:

E. If tiny filler stubs still expose out of the inter-thread stitched along the embroidery paths 50*a*, 60*b* or 50*c*, they can be tucked into the embroidery pattern and hidden inside by a small sharp stick 80 (as shown in FIG. 7), thereby embellishing the embroidery pattern.

Figure 8:
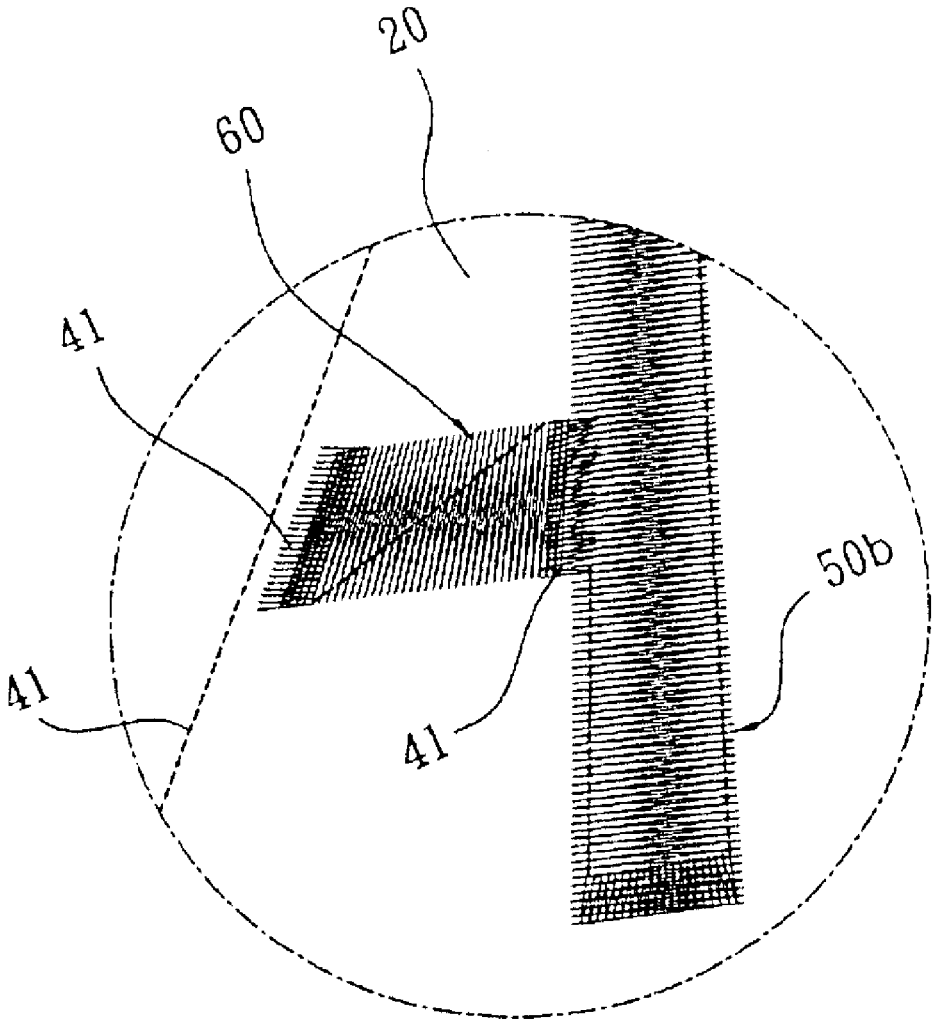
FIG. 8 is a partially enlarged view of the embroidery during the process.

Concluded above, in one preferred embodiment as shown in FIGS. 4 and 8, when proceeding the supplementary embroidering procedure on the short sides A of the embroidery pattern (as shown in FIG. 2) or the area 41 where different directions of outmost surface embroidering threads of the 3D embroidery design being adjacent (as shown in FIG. 2). Whereas the connecting stitches (42) in-between said short sides and/or said adjoining areas is processed inside the edge of the raised embroidery paten area (30), such that the threads going along the embroidery paths 50*a*, 50*b*, 50*c* will spread all over the raised embroidery pattern area 30 and entirely cover and wrap the supplementary embroidering on each short side 40 and/or said adjoining areas, as well as the connecting stitches 42 portion.

While certain novel features of this invention have been shown and described and are pointed out in the annexed Claims, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A raised embroidery process, including the following steps:

A. placing a piece of filler on an embroidering background fabric such that the filler, having a size larger than that of the raised embroidery pattern, may cover the pre-determined embroidery pattern;

B. conducting a supplementary embroidering procedure, i.e. sewing by threads of appropriate colors from the edge of short sides (40) of the embroidery pattern toward the inner portion of the pattern, thereby apart of the filler can be sewed and affixed to the corresponding background fabric;

C. entirely wrapping up the embroidering portion of the filler and the background fabric by sewing with treads of various colors along the pre-determined embroidery paths (50*a*, 50*b*, 50*c*); and D. removing the outer portion of the filler surrounding the embroidering portion from the embroidering portion, and passing the whole background fabric with the wrapped filler through an oven conveyor at a pre-set temperature, so that the filler will shrink to form an aesthetic raised embroidery pattern.

2. The raised embroidery process according to claim 1, wherein the supplementary embroidering process includes sewing the connecting stitches between the short sides of the pattern.

3. The raised embroidery process according to claim 1, wherein any filler stub exposed among the threads can be tucked inside of embroidery threads by a sharp stick, thereby embellishing the embroidery pattern.

4. The raised embroidery process according to claim 1, wherein step B for sewing by threads of appropriate colors from the edge of short sides of the embroidery pattern toward the inner portion of the pattern may include proceeding a supplementary embroidering on the adjoining area (41).

5. The raised embroidery process according to claim 1, wherein the embroidery paths **(50*a*, 50*b*, 50*c*) are for stitching threads to cover half of the adjoining area (41), such that filler would not expose from the adjoining area (41) of threads of different embroidery paths (50*a*, 50*b*)**.

6. The raised embroidery process according to claim 1, wherein the supplementary embroidering is processed partially from the edge of the short sides toward the inner portion of the embroidery pattern, while the connecting stitches (42) in-between the short sides and/or the adjoining areas of the pattern are processed inside the edge of the raised embroidery pattern area (30).

* * * * *